US010370900B2

(12) United States Patent
Patterson

(10) Patent No.: US 10,370,900 B2
(45) Date of Patent: Aug. 6, 2019

(54) REMOTE CONTROL OF STROKE AND FREQUENCY OF PERCUSSION APPARATUS AND METHODS THEREOF

(71) Applicant: TEI Rock Drills, Inc., Montrose, CO (US)

(72) Inventor: William N. Patterson, Montrose, CO (US)

(73) Assignee: TEI ROCK DRILLS, INC., Montrose, CO (US)

( * ) Notice: Subject to any disclaimer, the term of this patent is extended or adjusted under 35 U.S.C. 154(b) by 354 days.

(21) Appl. No.: 15/224,029

(22) Filed: Jul. 29, 2016

(65) Prior Publication Data

US 2017/0030182 A1 Feb. 2, 2017

Related U.S. Application Data

(60) Provisional application No. 62/199,670, filed on Jul. 31, 2015.

(51) Int. Cl.
*E21B 4/14* (2006.01)
*B25D 9/26* (2006.01)
(Continued)

(52) U.S. Cl.
CPC ..... *E21B 4/14* (2013.01); *B25D 9/12* (2013.01); *B25D 9/26* (2013.01); *E21B 44/02* (2013.01)

(58) Field of Classification Search
CPC ..... B66C 13/18; E21B 7/025; E21B 7/022; E21B 15/045; E21B 6/00; E21B 1/00;
(Continued)

(56) References Cited

U.S. PATENT DOCUMENTS 2,295,130 A * 9/1942 Schreiber ..... B23D 7/00 409/320
2,631,012 A * 3/1953 Kendrick ..... E21B 1/02 175/56

(Continued)

FOREIGN PATENT DOCUMENTS

| | | | |
|---|---|---|---|
| EP | 0112810 | A2 | 7/1984 |
| GB | 1584810 | A | 2/1981 |
| WO | 2015039162 | A1 | 3/2015 |

OTHER PUBLICATIONS

International Search Report and Written Opinion issued in corresponding PCT Appln. No. PCT/US2016/044803 dated Oct. 6, 2016.

(Continued)

*Primary Examiner* — Robert F Long
(74) *Attorney, Agent, or Firm* — Foley & Lardner LLP

(57) ABSTRACT

This disclosure describes methods and systems for remote control of stroke length and frequency of percussion apparatus, such as a rock hammer drill. At a high level, the hammer drill is allowed to stay at a default low stroke length and high frequency to avoid applying excessive cyclic stress to the housing of the hammer drill and can be controlled to operate at a long stroke length and low frequency when the hammer drill has engaged the target material. The long stroke length and low frequency during operation can be initiated when a sufficient forward feed pressure is provided. While the hammer drill is idling or retracting, the forward fee pressure is not sufficient for the long stroke length operation and thus the drill operates at the default state and at a safe stress level to avoid premature damage.

15 Claims, 4 Drawing Sheets

(51) Int. Cl.
*E21B 44/02* (2006.01)
*B25D 9/12* (2006.01)

(58) Field of Classification Search
CPC . E21B 44/02; E21B 4/14; G06F 17/00; B25D 17/06; B25D 9/26; B25D 9/04; B25D 2250/021; B25D 9/12
USPC ..... 173/2, 184
See application file for complete search history.

(56) References Cited

U.S. PATENT DOCUMENTS 2,823,446 A * 2/1958 Crane ..... B23D 49/007 16/245
3,759,335 A 9/1973 Coyne
3,773,438 A * 11/1973 Hall ..... E21B 43/26 417/345
3,816,034 A * 6/1974 Rosenquest, Jr. ..... F04B 43/073 417/395
3,995,700 A 12/1976 Mayer et al.
4,006,783 A 2/1977 Granholm
4,062,411 A 12/1977 Adkins et al.
4,246,973 A 1/1981 Mayer
4,342,255 A 8/1982 Watanabe et al.
4,548,278 A * 10/1985 Gidlund ..... B22D 31/00 173/121
6,202,994 B1 * 3/2001 Spurlin ..... F16F 1/3842 198/752.1
6,491,114 B1 12/2002 Webel
7,013,996 B2 * 3/2006 Keskiniva ..... E21B 1/02 173/201
7,891,437 B2 * 2/2011 Keskiniva ..... E21B 1/00 173/1
2009/0188686 A1 * 7/2009 Keskiniva ..... B25D 9/26 173/1
2010/0170931 A1 * 7/2010 Viola ..... A61B 17/128 227/175.1
2011/0139475 A1 * 6/2011 Braun ..... B25D 9/10 173/112
2013/0319765 A1 * 12/2013 Piipponen ..... E21B 7/02 175/24
2014/0144660 A1 5/2014 Sangster et al.
2015/0174748 A1 * 6/2015 Furuta ..... B25C 1/04 227/130
2015/0375382 A1 * 12/2015 Autschbach ..... B25D 9/12 173/20
2016/0001432 A1 * 1/2016 Kela ..... B25D 9/12 173/208

OTHER PUBLICATIONS

International Preliminary Report on Patentability issued in corresponding PCT Appln. No. PCT/US2016/044803 dated Feb. 15, 2018, 10 pages.
Extended European Search Report for European Patent Application No. EP 16833631 dated Nov. 27, 2018, 9 pages.

* cited by examiner

REMOTE CONTROL OF STROKE AND FREQUENCY OF PERCUSSION APPARATUS AND METHODS THEREOF

CROSS REFERENCE TO RELATED APPLICATIONS

This application claims priority to U.S. Provisional Application No. 62/199,670 filed on Jul. 31, 2015, which is incorporated herein by reference in its entirety.

TECHNICAL FIELD

This disclosure relates to a percussion apparatus, in particular, related to remote control of stroke and frequency of a reciprocating component of the percussion apparatus.

BACKGROUND

A percussion apparatus, such as hammer rock drills, are designed to deliver a repetitive impact in the axial direction of a rotating component (e.g., a drill bit). The axial impact forces the rotating component to engage a target material. In many instances however, when the percussion apparatus disengages from the target material, the repetitive impact continues and the percussion energy is then absorbed by the housing or other structures of the apparatus. This typically occurs when the apparatus is retracted or idling. This continuous repetitive impact negatively affects the life of the percussion apparatus as the absorbed energy causes fatigue in the housing or other structures of the apparatus.

SUMMARY

This disclosure describes methods and systems for remote control of stroke length and frequency of percussion apparatus, such as a rock hammer drill. At a high level, the hammer drill is allowed to stay at a default setting of short stroke length and high frequency to avoid producing excessive cyclic stress to the housing of the hammer drill and can be controlled to operate at a long stroke length and low frequency when the hammer drill has engaged the target material. The long stroke length and low frequency during operation can be initiated when a sufficient feed forward pressure is provided. While the hammer drill is idling or retracting, the feed forward pressure is not sufficient for the long stroke length operation and thus the drill operates at the default state and at a safe stress level to avoid premature damage.

In a first aspect, there is provided a method for controlling a percussion apparatus for an extended life of operation, the method including operating the percussion apparatus at a first stroke length and at a first frequency, wherein the first stroke length and the first frequency generate a low stress level to reduce fatigue in the percussion apparatus. The method further includes receiving a user selection for a second stroke length and a second frequency, wherein the second stroke length is longer than the first stroke length and the second frequency is lower than the first frequency such that a high stress level increases fatigue in the percussion apparatus when the percussion apparatus has yet engaged with an operation target. In addition, the method includes providing a feed forward pressure to a sliding selector controlling the piston hammer stroke length and the frequency according to the user selection and in response to an actuation input and in response to the feed forward pressure lower than a threshold level, maintaining the first stroke length and the first frequency. The method further includes that in response to the feed forward pressure higher than the threshold level, increasing the first stroke length to the second stroke length and reducing the first frequency to the second frequency.

In other embodiments, the actuation input comprises a command to increase the feed forward pressure above the threshold value at a remote control unit.

In still other embodiments, increasing the first stroke length and reducing the first frequency further includes translating a stroke selection piston biased by a resilient member.

In other embodiments, the stroke selection piston continuously receives a biasing force from the resilient member for remaining in a default mode corresponding to the first stroke length and the first frequency until the feed forward pressure overcomes the biasing force and actuates the stroke selection piston.

In yet other embodiments, the method further includes retracting the percussion apparatus at the first stroke length and the first frequency.

According to a second aspect, there is provided a remote control system for reducing cyclic percussion stress, the remote control system including a percussion apparatus having a sliding selector biased toward a default setting. The default setting corresponds to a first stroke length and a first frequency of a reciprocating component, wherein the sliding selector includes a stroke selection piston operable to change the first stroke length and the first frequency. The apparatus further includes a cylinder having a hammer piston controlled by the sliding selector and a source providing a feed forward pressure to the sliding selector, wherein the feed forward pressure increases in response to a user selection of a second stroke length and a second frequency and an actuation input supplying the feed forward pressure to the sliding selector. The apparatus actuates the stroke selection piston when the feed forward pressure is greater than a threshold value.

According to some embodiments, the source includes a motor feed drive regulated with a filter and pressure control unit.

In still other embodiments, the apparatus further includes a valve bank for generating the actuation input and adjusting the feed forward pressure.

In yet other embodiments, the valve bank is operated by a remote control unit.

In still other embodiments, the apparatus further includes a plurality of control ports controlled by the sliding selector for increasing the piston hammer stroke length and reducing the frequency to facilitate a drilling operation.

According to some embodiments, the sliding selector is set at the default setting in response to the percussion apparatus retracting or idling.

In still other embodiments, the first stroke length and the first frequency of the hammer piston produce a cyclic stress level in the cylinder lower than a fatigue stress level; and the second stroke length and the second frequency of the hammer piston produce a cyclic stress level greater than the fatigue stress level in the cylinder.

According to a third aspect, there is provided a percussion apparatus having a reciprocating component producing an axial impact on a rotating component, the reciprocating component being housed in a cylinder. The apparatus further includes a sliding selector and a resilient member applying a continuous force biasing a selection piston toward a default setting, the default setting corresponding to a first stroke length and a first frequency of the reciprocating component. The sliding selector changes the first stroke length and the first frequency in response to a feed forward pressure when the feed forward pressure exceeds a threshold value, the threshold value corresponding to a value of the continuous force that the resilient member acts on the selection piston to allow for selecting an operation setting of a second stroke length and a second frequency.

According to some embodiments, the percussion apparatus further includes a primary housing enclosing the selection piston and a secondary housing enclosing at least a portion of the resilient member, wherein the secondary housing is affixed to the primary housing.

In other embodiments, the primary housing has a plurality of control ports hydraulically connected to the cylinder of the reciprocating component.

In still other embodiments, the percussion apparatus further includes a pressure relief valve for limiting the feed forward pressure.

In yet another embodiment, the percussion apparatus is a hammer drill and the reciprocating component is a hydraulically actuated hammer piston.

In still another embodiment, the first stroke length and the first frequency produce a cyclic stress level lower than a fatigue stress level; and the second stroke length and the second frequency produce a cyclic stress level greater than the fatigue stress level.

According to other embodiments, the first stroke length is shorter than the second stroke length and the first frequency is correspondingly higher than the second frequency. In yet another embodiment, the sliding selector is operable to further select a third stroke length and a third frequency, the third stroke length has a value between the first and the second stroke lengths, and the third frequency has a value between the first and the second frequencies.

DETAILED DESCRIPTION

Figure 1:
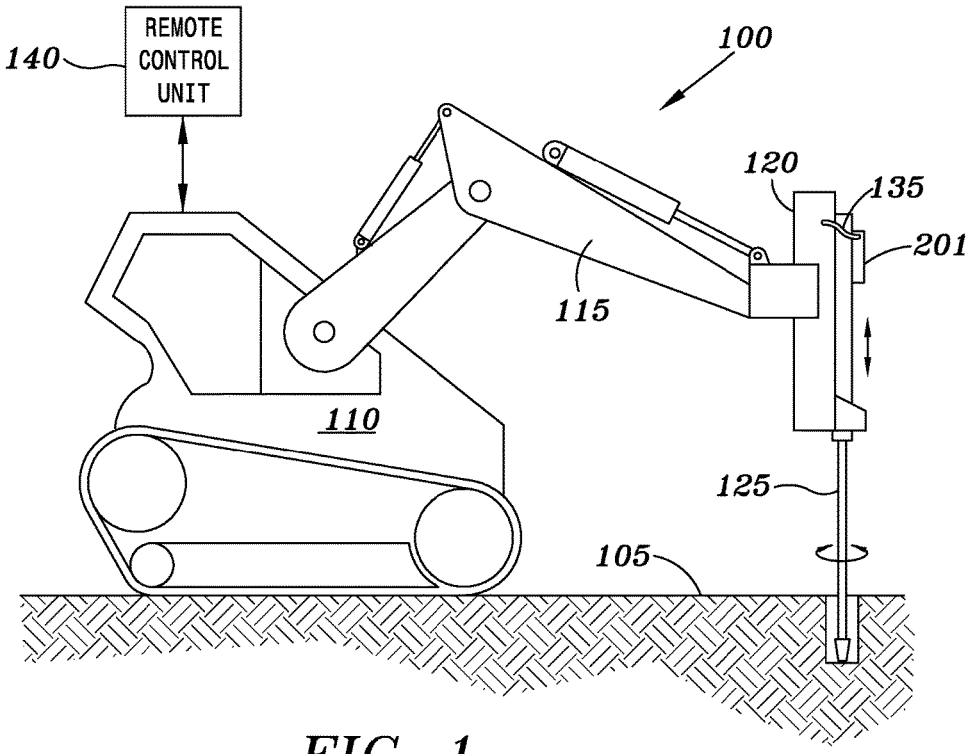
FIG. 1 is an illustration of a hydraulic percussion tool, in which a hydraulic pressure fluid circuit for remote control of the hydraulic percussion tool is employed to advantage.

This disclosure presents an apparatus, method, and system of remote control for reducing fatigue failures in percussion tools, such as, for example, rock hammer drills. In many instances, a percussion tool has a reciprocating component that generates repetitive impact to a tool bit, such as a drill bit that engages a target material (e.g., often a hard surface). The repetitive impact is designed to be absorbed by the target material during operation, but when the tool bit is not engaged with the target material, the repetitive impact is dissipated internally, often to the cylinder that houses the reciprocating component or associated housing structures. Such impact can result in fatigue in the housing and eventually cause fracture or other forms of structural failure, thus shortening the life of operation of the percussion tool. This disclosure addresses this problem by reducing the stress level when the tool bit has yet engaged the target material thereby extending the overall life of the equipment.

Hydraulically controlling the hammer stroke length and the frequency is known. For example, U.S. Pat. No. 4,062,411, which is incorporated herein by reference in its entirety, discloses using hydraulic means to move a valve that controls piston hammer blows. This disclosure, however, focuses on remote control of a percussion apparatus such that the apparatus operates in a default setting or mode to protect the apparatus from fatigue even if a selection has been made for a long stroke length (and thus high stress level) setting until an engagement command is given.

In one embodiment, a hydraulic powered rock drill has two modes for its hammer stroke: a first or short stroke mode having a short stroke with high frequency and a second long stroke mode having a long stroke with low frequency. The long stroke mode has increased impact power and impact force, but can increase the likelihood of fatigue failure in the tool housing when the tool is not engaged with operation target. It should be understood, however, that a different number of modes may be utilized. For example, in some embodiments, the hydraulic powered rock drill has three, four or even more modes for its hammer stroke. In embodiments disclosed herein, the rock drill defaults to the short stroke mode of operation to avoid and/or otherwise minimize stress levels causing fatigue on the equipment. In operation, when a user selects the long stroke mode, but does not operate the rock drill (such as controlling or otherwise positioning the drill forward), the stroke length and the frequency setting will remain unchanged. However, when a feed forward pressure is applied and when such pressure exceeds a predetermined threshold level, the mode will automatically change from the first or short stroke mode to the second or long stroke mode. Likewise, when a feed forward pressure falls below the predetermined threshold level, the mode automatically changes from the second mode to the first mode. Therefore and as discussed more fully below, when the rock drill is idling or is retracting, for example, excessive stress on the equipment is lessened thereby reducing the likelihood of fatigue failure. Detailed examples are discussed below.

FIG. 1 is an embodiment of a hydraulic percussion tool 100. The percussion tool 100 includes a percussion apparatus 120 positioned to operate on a target 105. The percussion apparatus 120 can be, for example, a drifter, a hammer drill, or other type of device. A positioner 115 supported by a support 110 holds and otherwise places the percussion apparatus 120 in a desired position. The support 110 may be a mobile vehicle or a stationary structure and provides power for operating the positioner 115 and the percussion apparatus 120. A remote control unit or terminal 140 controls the percussion apparatus 120 via connection with the support 110. In some examples, the connection between the remote control unit 140 and the support 110 can be wired (e.g., via wires or cables); in other embodiments, the connection may be wireless (e.g., via wireless network). In operation, a user may use the control unit 140 onsite, such as at or near the support 110, or may be operating off-site using appropriate network technologies.

In the embodiment illustrated in FIG. 1, the percussion apparatus 120 includes at least one or more control line 135 and a drill bit 125 for engaging the target 105. In some embodiments, the control line 135 is connected to the hydraulic power of the overall system including the support 110 and the positioner 115. In other embodiments, the control line 135 may derive independent hydraulic power at the percussion apparatus 120 and be remotely controlled by the remote control unit 140.

Figure 2:
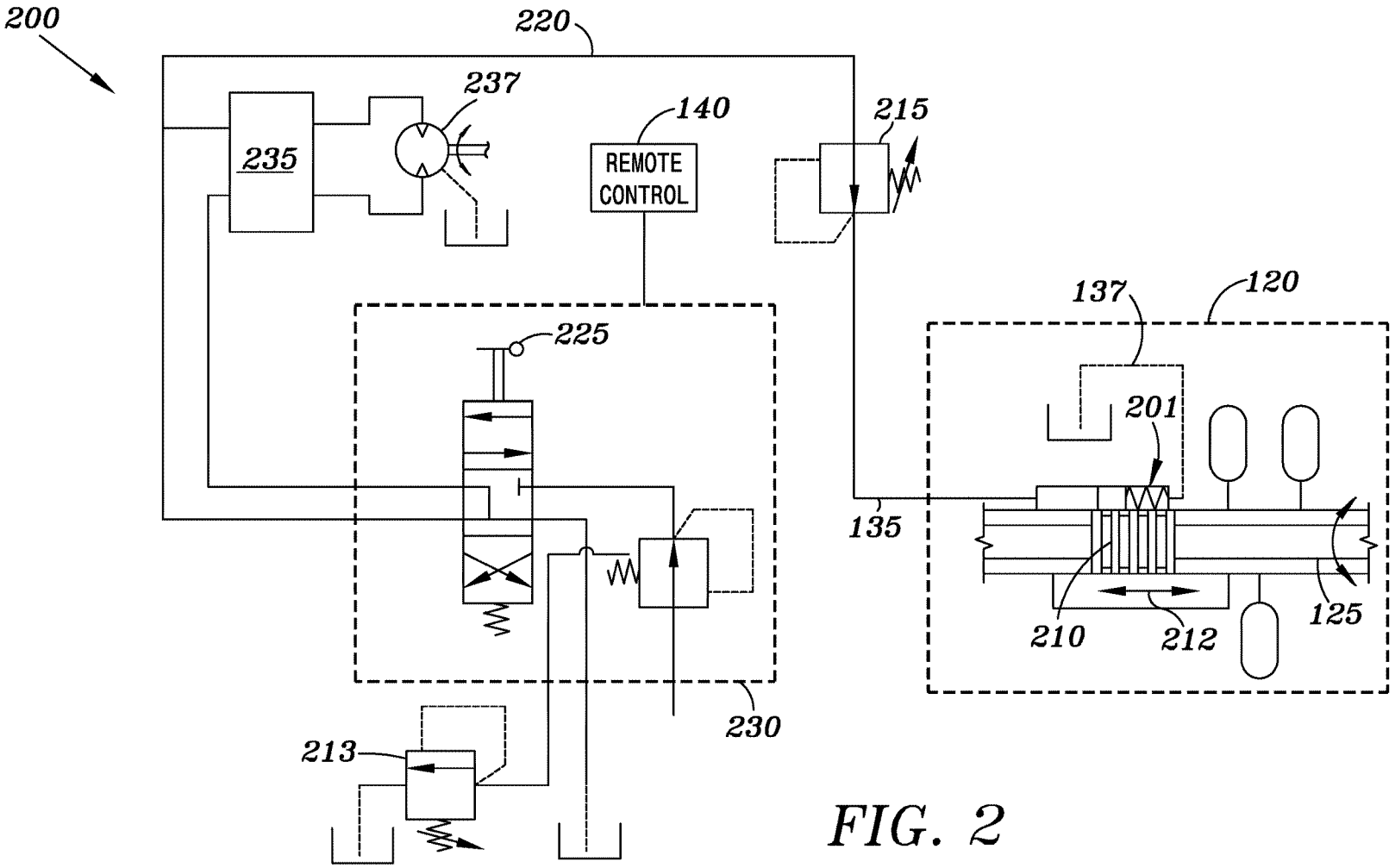
FIG. 2 is a schematic of a hydraulic pressure fluid circuit for remote control of the hydraulic percussion tool of FIG. 1.

FIG. 2 is a schematic view of a hydraulic pressure fluid circuit 200 for remote control of the hydraulic percussion tool 100 of FIG. 1. In the embodiment illustrated in FIG. 2, the circuit 200 is in fluid communication with the percussion apparatus 120, which includes a sliding selector 201 that is biased toward and otherwise positioned in a default mode to operate in the short stroke mode such that a hammer piston 210 operates with a short stroke length and a high frequency. As illustrated and as explained in greater detail below, the hammer piston 210 reciprocates in a drill cylinder 212 and repetitively impacts with the drill bit 125 to operate on the target 105.

With continued reference to FIG. 2, the hydraulic pressure fluid circuit 200 further includes a hydraulic power source, such as a motor feed drive 237, which provides a circulating pressure for the system. The circuit 200 further includes a filter and pressure control unit 235 that regulates the pressure output from the motor feed drive 237. For example, the filter and pressure control unit 235 may include one or more filters, valves, and adjustment mechanisms for regulating the hydraulic power output from the motor feed drive 237. A valve bank 230 in the circuit 200 enables a user to provide the actuation input via the remote control unit 140. According to some embodiments, the valve bank 230 includes a lever 225 or other mechanism having similar functions, which is remotely controlled by the remote control unit 140. The lever 225 is used by a drill operator to move the percussion apparatus 120 into contact with the target 105, to retract the percussion apparatus 120 from the target 105, and stop the motion of the percussion apparatus 120.

In FIG. 2, pressure relief or adjustment valves 213 and 215 are placed at various locations in the circuit 200 to limit or otherwise control the allowable hydraulic pressure in the circuit 200. For example, the adjustment valve 215 is used to set an upper pressure limit for feed forward pressure in the control line 135. In some embodiments, the valve bank 230 controls the feed forward pressure according to the remote control unit 140. As described more fully below, the circuit 200 further includes a hydraulic return line 137 for the sliding selector 201 to return hydraulic fluids in the circuit 200.

In operation, a user operates the system to apply a feed forward pressure to the percussion apparatus 120. For example, the user may first select a mode, which includes a working stroke length and frequency. The working stroke length is longer than the default stroke length, and the working frequency is lower than the default frequency for the hammer piston 210 in order to produce high impact loads. Further, the user may provide an actuation input, such as an operation at the remote control unit 140 to command a feed forward operation. In other embodiments, the actuation input may be provided in response to operation of the percussion apparatus 120, such as pressing the drill bit 125 against the target surface 105. In response to the actuation input, the feed forward pressure increases and becomes, as discussed in greater detail below, greater than a threshold value to change the mode of operation (i.e., the stroke length and frequency).

Figure 3A:
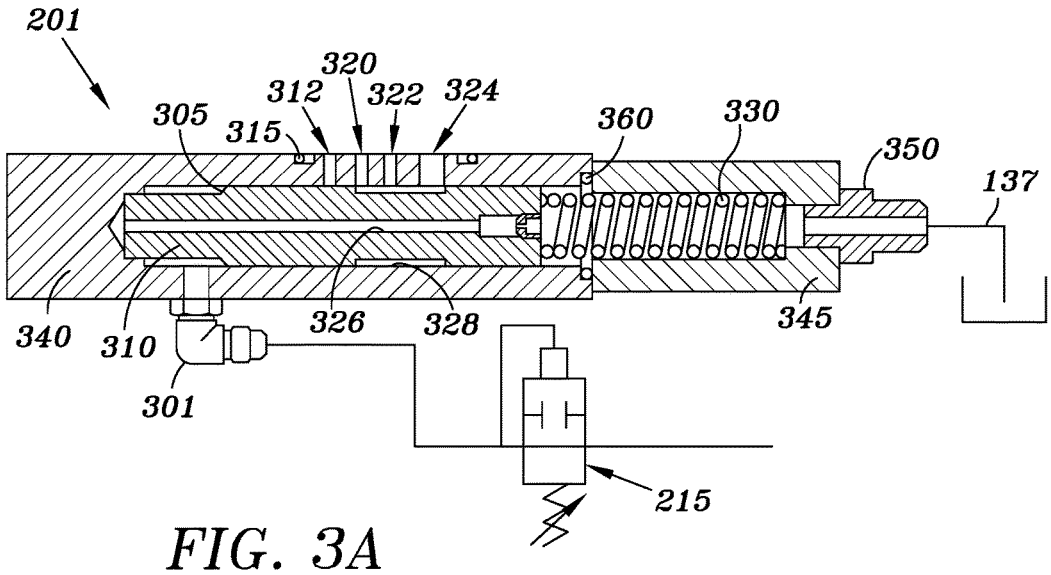
FIG. 3A is a cross sectional side view of a sliding selector.

Referring now to FIG. 3A, a cross-sectional view of the sliding selector 201 of FIG. 2 is illustrated. In the embodiment illustrated in FIG. 3A, the sliding selector 201 includes a stroke selection piston 310 and a resilient member 330 that applies a continuous force against the stroke selection piston 310, both being operable to change the stroke length and the frequency of the hammer piston 210 such that the percussion apparatus 120 is operable between the different modes of operation. In particular, the selection piston 310 is movable in an axial direction, as indicated by arrows 325, to control the flow of fluid through a plurality of ports 312, 320, 322, and 324, which selects and/or otherwise configures the percussion apparatus 120 in the desired mode of operation (i.e., short stroke mode, long stroke mode or otherwise). In the embodiment illustrated in FIG. 3A, the control ports 312, 320, 322, and 324 are formed in a first housing 340 and hydraulically connected to the selection piston 310.

In the embodiment illustrated in FIG. 3A, three options of the stroke length and the frequency combinations are provided, including a long stroke length at low frequency, a medium stroke length at medium frequency, and a short stroke length at high frequency. The impact loads due to the percussion decreases as the stroke length decreases and the frequency increases. In other embodiments, more than three stroke lengths and frequency combinations may be provided. In other instances, the variation of the stroke length may be continuous and the change of the operation frequency corresponds to the change of stroke length. In FIG. 3A, the control ports 320, 322, and 324 respectively correspond to a short stroke-high frequency setting (i.e., the default setting), a medium stroke-medium frequency setting, and a long stroke-low frequency setting (i.e., the operation setting). In some embodiments, there may be additional settings in between the default setting and the operation setting. In other instances, the medium stroke-medium frequency setting may be omitted. In the embodiment illustrated in FIG. 3A, the sliding selector 201 includes a resilient member 330 extending from within the second housing 345 so as to apply a continuous force biasing the selection piston 310 toward the default setting (e.g., a short stroke length and a high frequency) of the hammer piston 210.

At default settings, such as when the percussion apparatus 120 retracts or idles, the sliding selector 201 operates so that the hammer piston 210 operates at the default short stroke length and the high frequency. The stroke length and the frequency generate reduced stress levels in the drill cylinder 212 and minimize fatigue therein. For example, the default stroke length and the default frequency of the hammer piston 210 produce a cyclic stress level in the cylinder lower than a fatigue stress level. Actual stress levels, however, depends on the material and scale of the drill cylinder 212. By contrast, the operation stroke length and frequency of the hammer piston 210 may produce a cyclic stress level greater than the fatigue stress level in the cylinder, if the percussion apparatus 120 is not engaged with the target 105. Therefore, the sliding selector 201 can effectively avoid accumulating fatigue inducing stresses by reducing the situations of producing high repetitive impact loads while the percussion apparatus 120 has yet engaged with feed forward operations.

With continued reference to FIG. 3A, the selection piston 310 and the resilient member 330 are respectively housed in the first housing 340 and a second housing 345. The second housing 345 is sealingly secured to the first housing 340. An exit port 350 is attached to the second housing 345 for recirculating the hydraulic fluid via the return line 137. The selection piston 310 further includes a conduit 326 that allows fluids to flow through to recirculate the hydraulic fluids in the circuit 200. During operation, the valve bank 230 (FIG. 2) supplies the feed forward pressure through a line 220 to a port 301 on the first housing 340. The adjustment valve 215 is hydraulically connected to the port 301 to limit the allowable feed forward pressure to be applied into the system.

In operation, the feed forward pressure produces a force on a shoulder 305 of the selection piston 310. When the pressure exceeds a threshold value that is equivalent to the force exerted by the resilient member 330, the feed forward pressure pushes the selection piston 310 toward the exit port 350 and the selection groove 328, an area that is formed of a reduced diameter on the sliding selection piston 310, moves toward the second housing 345 to limit and/or otherwise restrict hydraulic flow through the port 324. This change of fluid flow selects the setting for the hammer piston 210 to be operating in a mode other than the short stroke mode, such as the long stroke mode (i.e., operating at a long stroke length and a low frequency).

In the present embodiment, the default short stroke mode produces a cyclic stress level lower than a fatigue stress level (e.g., when the resilient member 330 pushes the selection piston 310 into the first housing 340 such that the selection groove 328 opens to all three control ports 320, 322, and 324). On the other hand, the long stroke mode of operation occurs when only the control port 324 is selected (i.e., open?) and can produce a cyclic stress level greater than the fatigue stress level if the reciprocating impact energy is not transferred to the target surface.

By comparison, a conventional percussion apparatus 120 can have a reciprocating component acting at a fatigue stress level whenever the apparatus disengages from the work surface, such as when retracting the apparatus or leaving the apparatus idle. The percussion apparatus 120 avoids such constant high stress level by automatically setting the stroke of the hammer piston 210 at the default setting whenever the feed forward pressure is less than the threshold level. Thus, the sliding selector 201 effectively reduces fatigue in the percussion apparatus 120 and extends its operational life compared to conventional models.

Figure 3B:
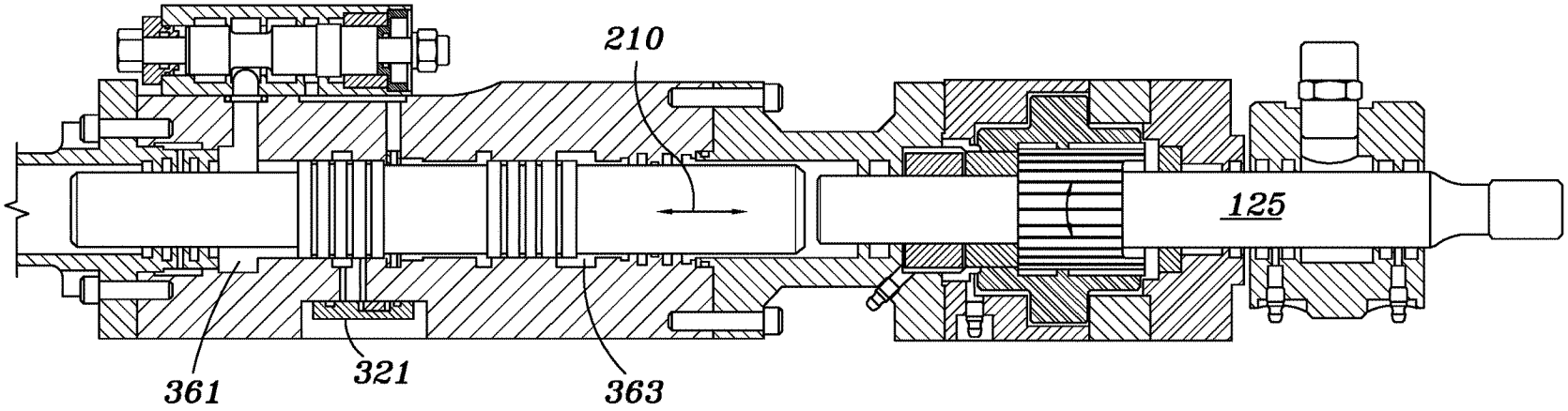
FIG. 3B is a cross sectional side view of a hammer piston and a rotating tool bit.

FIG. 3B is a cross sectional side view of the hammer piston 210 and the rotating tool bit 125. In particular, FIG. 3B illustrates an example configuration of the assembly of the percussion portion of the percussion apparatus 120. The housing 365 encloses the hammer piston 210 and the drill bit 125, wherein the rotating shank of the drill bit 125 receives repetitive impact from the hammer piston 210. The hammer piston 210 is actuated by the pressure differences in the spaces 361 and 363. For example, when the space 361 has a higher hydraulic pressure than that of the space 363, the hammer piston 210 is actuated toward the drill bit 125; otherwise when the hydraulic pressure in the space 361 is lower, the hammer piston 210 is actuated away from the shank of the drill bit 125.

The differences and timing of the pressure variations in the spaces 361 and 363 are controlled with the stroke control plate 321 connected to the sliding selector 201, which has been discussed in detail in FIG. 3A. In some embodiments, the stroke control plate 321 includes a plurality of ports communicating with the ports 312, 320, 322, and 324 of the sliding selector 201. The stroke control plate 321 allows the assembly to react to the pressure changes as the stoke selection piston 310 moves to connect and disconnect the ports 312, 320, 322, and 324, varying percussion frequency and stroke length. Although FIG. 3B provides an example of receiving the control signals from the sliding selector 201, other configurations are possible.

Figure 4:
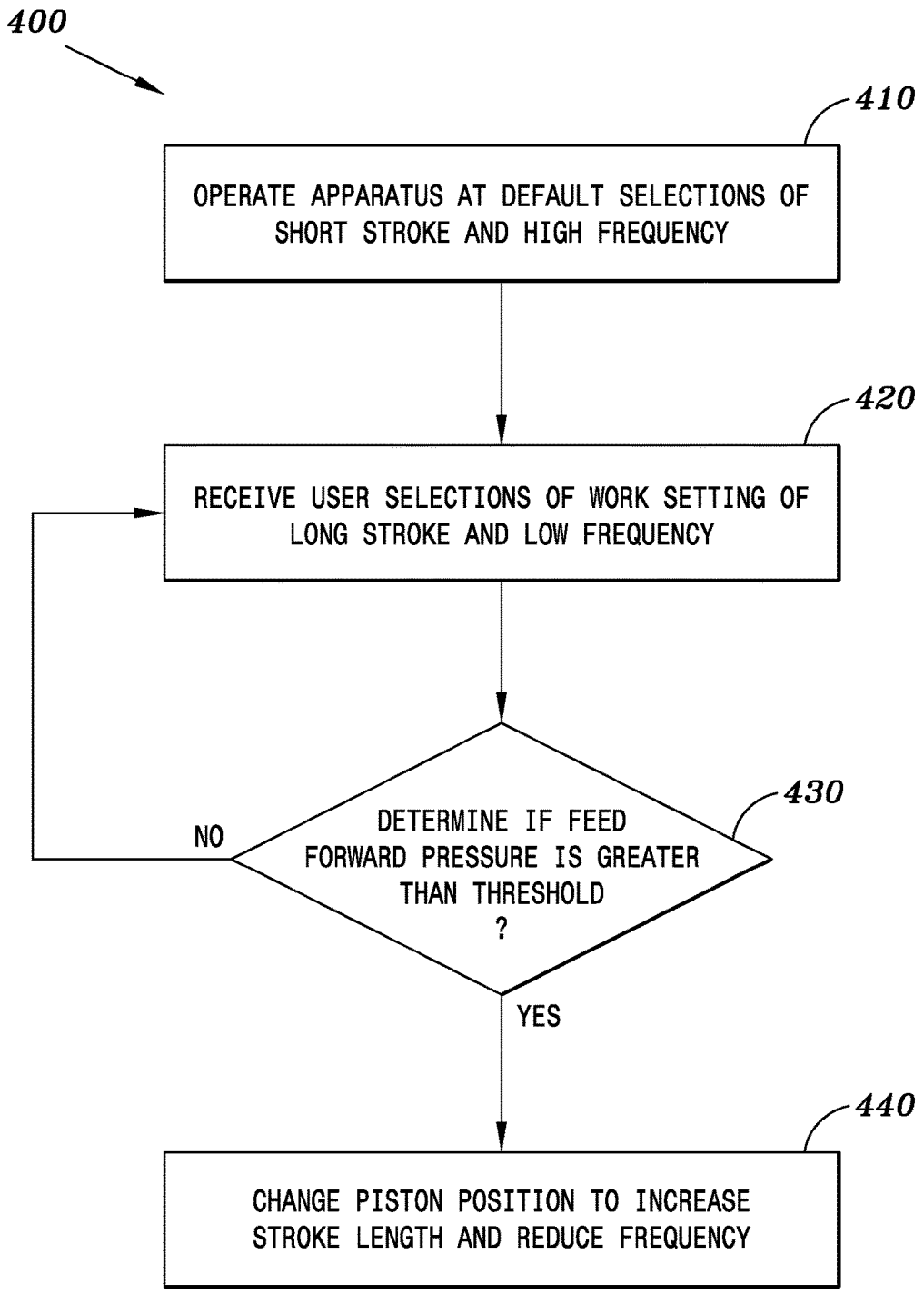
FIG. 4 is a flow chart illustrating the method of remote control of stroke length and frequency of a percussion apparatus.

FIG. 4 is a flow chart 400 illustrating the method of remote control of stroke length and frequency of a percussion apparatus 100 at lower stress levels to extend total operation life thereof. At step 410, the percussion apparatus 100 is operated under a default selection of a first stroke length and at a first frequency. The first stroke length is relatively short and the first frequency is relatively high such that they generate a low stress level for avoiding fatigue in the percussion apparatus.

At step 420, a user selection is received about a second stroke length and a second frequency. For example, the second stroke length and the second frequency correspond to an operational setting that generates high reciprocating impact forces. The second stroke length is longer than the default stroke length, and the second frequency is lower than the first frequency. Therefore, when the percussion apparatus 100 has yet engaged with the target surface, the second stroke length and the second frequency can cause a high stress level resulting in an increased likelihood of fatigue in the percussion apparatus 100. The setting selection would further require an actuation input to change the actual output parameters of the percussion apparatus 100. The actuation input depends on the user operation on a remote control unit (e.g., commanding an increase of the feed forward pressure), or depends on an automatic increase of feed forward pressure in response to the apparatus engaging the target surface.

At step 430, a feed forward pressure is provided to a sliding selector 201 controlling the piston hammer stroke length and the frequency according to the user selection and in response to an actuation input. For example, a user may operate on a remote control unit to create the actuation input to a valve bank for adjusting the feed forward pressure. When the feed forward pressure is lower than a threshold value (e.g., wherein the feed forward pressure cannot overcome a biasing load of a resilient member, such as the resilient member 330), the percussion apparatus 100 maintains the first stroke length and the first frequency. For example, the stroke selection piston 310 continuously receives a biasing force from the resilient member for remaining at a default state corresponding to the first stroke length and the first frequency until the feed forward pressure overcomes the biasing force and actuates the stroke selection piston, as in step 410. In some embodiments, when the percussion apparatus 100 is retracted, the retraction prevents the feed forward pressure from exceeding the threshold value and thus maintaining the stroke length and the frequency at the default setting.

At step 440, when the feed forward pressure exceeds the threshold value, such as when the actuation input relates to a feed forward command from the user, the length of the hammer stroke increases to the second stroke length and the frequency reduces to a second frequency. For example, at step 450, the feed forward pressure translates a sliding selection piston 310 biased by the resilient member 330 to select the operational setting. The selection piston 310 then allows hydraulic flow through a control port for the work setting.

In some embodiments, a medium setting may be selected to configure medium stroke lengths and medium frequencies as needed in different situations. In one embodiment, the pressure required for moving the selection cylinder is about 200 psi (14 bar). This pressure may be regulated by the hammer stroke selector pressure reducing valve, such has the valve 230 in FIGS. 2 and 3. In many examples, the feed forward pressure can reach about 600-1200 psi (41-48 bar) range. Thus, the pressure required to select the working stroke length (i.e., the long stroke) of about 400 psi is much less than the feed forward pressure. Other values of the feed forward pressure may be specified depending on the configuration and output of the percussion apparatus.

In the foregoing description of certain embodiments, specific terminology has been resorted to for the sake of clarity. However, the disclosure is not intended to be limited to the specific terms so selected, and it is to be understood that each specific term includes other technical equivalents which operate in a similar manner to accomplish a similar technical purpose. Terms such as "left" and right", "front" and "rear", "above" and "below" and the like are used as words of convenience to provide reference points and are not to be construed as limiting terms.

In this specification, the word "comprising" is to be understood in its "open" sense, that is, in the sense of "including", and thus not limited to its "closed" sense, that is the sense of "consisting only of". A corresponding meaning is to be attributed to the corresponding words "comprise", "comprised" and "comprises" where they appear.

In addition, the foregoing describes some embodiments of the disclosure, and alterations, modifications, additions and/or changes can be made thereto without departing from the scope and spirit of the disclosed embodiments, the embodiments being illustrative and not restrictive.

Furthermore, the disclosure is not to be limited to the illustrated implementations, but to the contrary, is intended to cover various modifications and equivalent arrangements included within the spirit and scope of the disclosure. Also, the various embodiments described above may be implemented in conjunction with other embodiments, e.g., aspects of one embodiment may be combined with aspects of another embodiment to realize yet other embodiments. Further, each independent feature or component of any given assembly may constitute an additional embodiment.

What is claimed is:

1. A percussion apparatus comprising:

a reciprocating component producing an axial impact on a rotating component, the reciprocating component housed in a cylinder;

a sliding selector comprising a resilient member applying a continuous force biasing a selection piston toward a default setting, the default setting corresponding to a first stroke length and a first frequency of the reciprocating component;

wherein the sliding selector changes the first stroke length and the first frequency in response to a feed forward pressure when the feed forward pressure exceeds a threshold value, the threshold value corresponding to a value of the continuous force that the resilient member acts on the selection piston, to allow for selecting an operation setting of a second stroke length and a second frequency; wherein the first stroke length and the first frequency produce a cyclic stress level lower than a fatigue stress level;

and the second stroke length and the second frequency produce a cyclic stress level greater than the fatigue stress level.

2. The percussion apparatus of claim 1, further comprising a primary housing enclosing the selection piston and a secondary housing enclosing at least a portion of the resilient member, wherein the secondary housing is affixed to the primary housing.

3. The percussion apparatus of claim 2, wherein the primary housing has a plurality of control ports hydraulically connected to the cylinder of the reciprocating component.

4. The percussion apparatus of claim 1, further comprises a pressure relief valve for limiting the feed forward pressure.

5. The percussion apparatus of claim 1, wherein the percussion apparatus is a hammer drill and the reciprocating component is a hydraulically actuated hammer piston.

6. The percussion apparatus of claim 1, wherein the first stroke length is shorter than the second stroke length and the first frequency is correspondingly higher than the second frequency.

7. The percussion apparatus of claim 6, wherein the sliding selector is operable to further select a third stroke length and a third frequency, the third stroke length has a value between the first and the second stroke lengths, and the third frequency has a value between the first and the second frequencies.

8. A percussion apparatus comprising:

a reciprocating component producing an axial impact on a rotating component, the reciprocating component housed in a cylinder;

a sliding selector comprising a resilient member applying a continuous force biasing a selection piston toward a default setting, the default setting corresponding to a first stroke length and a first frequency of the reciprocating component;

wherein the sliding selector changes the first stroke length and the first frequency in response to a feed forward pressure when the feed forward pressure exceeds a threshold value, the threshold value corresponding to a value of the continuous force that the resilient member acts on the selection piston, to allow for selecting an operation setting of a second stroke length and a second frequency, wherein the feed forward pressure is in response to an operation of the percussion apparatus and wherein the feed forward pressure increases when the percussion apparatus presses against a target surface.

9. The percussion apparatus of claim 8, further comprising a primary housing enclosing the selection piston and a secondary housing enclosing at least a portion of the resilient member, wherein the secondary housing is affixed to the primary housing.

10. The percussion apparatus of claim 9, wherein the primary housing has a plurality of control ports hydraulically connected to the cylinder of the reciprocating component.

11. The percussion apparatus of claim 1, further comprises a pressure relief valve for limiting the feed forward pressure.

12. The percussion apparatus of claim 8, wherein the percussion apparatus is a hammer drill and the reciprocating component is a hydraulically actuated hammer piston.

13. The percussion apparatus of claim 8, wherein the first stroke length and the first frequency produce a cyclic stress level lower than a fatigue stress level; and the second stroke length and the second frequency produce a cyclic stress level greater than the fatigue stress level.

14. The percussion apparatus of claim 13, wherein the first stroke length is shorter than the second stroke length and the first frequency is correspondingly higher than the second frequency.

15. The percussion apparatus of claim 14, wherein the sliding selector is operable to further select a third stroke length and a third frequency, the third stroke length has a value between the first and the second stroke lengths, and the third frequency has a value between the first and the second frequencies.

* * * * *